United States Patent [19]

Herzing

[11] Patent Number: 4,973,060

[45] Date of Patent: Nov. 27, 1990

[54] ARROWHEAD WITH EXPANDABLE BLADES

[76] Inventor: Mathew J. Herzing, P.O. Box 472, Black Hawk, Colo. 80422

[21] Appl. No.: 500,593

[22] Filed: Mar. 28, 1990

[51] Int. Cl.[5] ..... F42B 6/08

[52] U.S. Cl. ..... 273/421

[58] Field of Search ..... 273/416, 419, 421, 422

[56] References Cited

U.S. PATENT DOCUMENTS

| | | | |
|---|---|---|---|
| 2,859,970 | 11/1958 | Doonan | 273/421 |
| 2,993,697 | 7/1961 | Urban | 273/421 |
| 3,138,383 | 6/1964 | McKinzie | 273/421 |
| 4,166,619 | 9/1979 | Bergmann et al. | 273/421 X |
| 4,579,348 | 4/1986 | Jones | 273/421 |
| 4,932,671 | 6/1990 | Anderson, Jr. | 273/421 |
| 4,940,246 | 7/1990 | Stagg | 273/421 |

*Primary Examiner*—Edward M. Coven
*Assistant Examiner*—William E. Stoll
*Attorney, Agent, or Firm*—Charles C. Corbin

[57] ABSTRACT

An expandable broadhead for a hunting arrow includes a first elongate member having a rear end adapted to be releasably attached to the front end of an arrow shaft and a longitudinally extending forward portion. There is a second elongate member that has a tipped front end and a rearwardly extending portion adapted to slidably connect with the longitudinally extending forward portion of the first member, and for guiding the second member in axial movement relative to the first member from a forward position to a rearward position. Each of a pair of blades with sharpened outer edges has a front end that is pivotally connected to the second elongate member. There is a pair of linking arms, each arm having a rear end that is pivotally connected to the first elongate member and a forward end that pivotally connects with a blade at a point therealong spaced from the front end of the blade. The arrowhead has a first configuration in which the blades are retracted in a low-profile aerodynamic configuration, and in which the second elongate member is in its forward position. When the tipped portion of the second elongate member makes impact with a target, the aforedescribed construction will allow force of impact to move the second elongate member towards the first elongate member and to urge outwardly the connection point of each linking arm and blade to move the blades to an extended, divergent configuration.

19 Claims, 1 Drawing Sheet

ARROWHEAD WITH EXPANDABLE BLADES

BACKGROUND OF THE INVENTION

1. Field of the Invention.

The present invention relates generally to arrowheads for hunting arrows, and more particularly to an arrowhead which has blades that can extend from a retracted configuration upon impact with a target.

2. Description of the Prior Art

When hunting game animals with bow and arrow it is desirable to shoot with an arrow that is highly accurate and which can be highly effective at delivering a killing blow to the targeted animal.

Currently available game-hunting arrows include the well-known conventional broadhead design of arrowhead, which head includes at least three highly sharpened and divergent blades which are designed to facilitate penetration and damage to the game animal by way of cutting and trauma caused by the bladed arrowhead. Ideally, the kinetic energy of an arrow is transferred into a forceful, shock generating impact which is absorbed by the game target, however a highly sharpened broadhead hunting arrow which is shot by a powerful bow such as a compound bow will often actually pass completely through a game animal's body without having the intended disabling., lethal effect. An animal wounded in this fashion will require further tracking and hunting to insure that it is killed, and to avoid prolonged suffering of the animal. In an effort to overcome such limitations, even larger bladed arrowheads have been proposed. Unfortunately, the larger the arrowhead blades are made the more aerodynamically unsound will be the arrow. Such an enlarged arrowhead will bring increased air resistance, cause the projected arrow to windplane, will increase the susceptibility of the flying arrow to the effects of cross winds, down drafts and up drafts. It is further noted that large blades, particularly blades that exceed the width of the fletchings of an arrow, will tend to interfere aerodynamically with the performance of the fletchings which are designed to impart a stabilizing spin to a flying arrow.

SUMMARY OF THE INVENTION

In view of the aforestated shortcomings and limitations, it is a general object of the present invention to provide a broadhead for a hunting arrow with blades that are retracted during flight to give an aerodynamically sound configuration, yet which extends to an enlarged configuration upon impact with a target.

Another object is to provide an arrowhead with blades that have an effective cutting diameter which greatly increases upon impact with the body of a targeted animal.

Another related object is to provide an arrowhead which greatly expands its frontal cross-sectional area upon impact with a target so as to increase the likeliihood that all of the kinetic energy of the projected arrow will be imparted to the targeted animal.

Still another object is to provide a simple and reliable construction for an expandable arrowhead.

Yet another object is to provide, for a hunting broadhead, expandable blades that do not require the use of a spring loaded mechanism for their operation.

A still further object of the present invention is to provide a bladed arrowhead having a configuration which during flight is significantly smaller in radial extent than the blades of a conventional broadhead yet which upon impact with a target, has a configuration that is significantly greater in radial extent than the blades of a conventional arrow broadhead.

The aforestated and additional objects and advantages will be appreciated by those with ordinary skill in the art by reference to the present invention a described in this summary, the drawings, detailed description, and claims which follow.

Accordingly, the present invention provides an expandable head for a hunting arrow that includes a first elongate member having a rear end that is to releasably attach to the front end of an arrow shaft and including a longitudinally extending forward portion. A second elongate member has a pointed front end or tip, and a rearwardly extending portion that is adapted to slidably connect to the longitudinally extending forward portion of the first member and for guiding the second member in axial movement relative to the first member from a forward position to a rearward position.

Each of at least one pair of blades with sharpened outer edges has a front end that is pivotally connected to the second elongate member. The invention- further includes at least a pair of linking arms, each arm having a rear end that is pivotally connected to the first elongate member and a forward end that pivotally connects to a blade at a point that is spaced from the front end of the blade. Finally, the invention includes means operative between the forwardly extending portion of the first elongate member and the rearwardly extending portion of the second elongate member for exerting a predetermined amount of static frictional force for holding the first and second members against relative sliding movement. With the aid of this frictional holding means, the aforegiven construction will allow the arrowhead of the invention to assume a first configuration in which the blades are retracted and slightly inclined with respect to the longitudinal axis of the arrowhead so as to present an aerodynamically sound configuration; and when the arrowhead is in this retracted configuration the second elongate member lies in its forward position.

The foregoing mechanism will allow the arrowhead to have a second configuration in which the blades are highly divergent from the arrowhead's axis, to which configuration the blades are urged when the impact of the first elongate member with a target mass causes the first elongate member to move axially towards the first member and towards its rearward position. The aforedescribed blade linkage will transmit the inertial forces of impact into resultant forces which urge the blades upwardly.

In a preferred embodiment the rearwardly extending portion of the second elongate member is a tubular sleeve which receives the longitudinally extending forward portion of the first elongate member, and a predetermined amount of static friction between these parts is provided by an elastomer ring mounted on the longitudinally extending portion of the first member and engaging the inside of the tubular part of the second member. The rear of the sleeve will abut the first member to hold against further rearward movement of the second member beyond its rearward position.

DETAILED DESCRIPTION OF THE DRAWINGS

Figure 1:
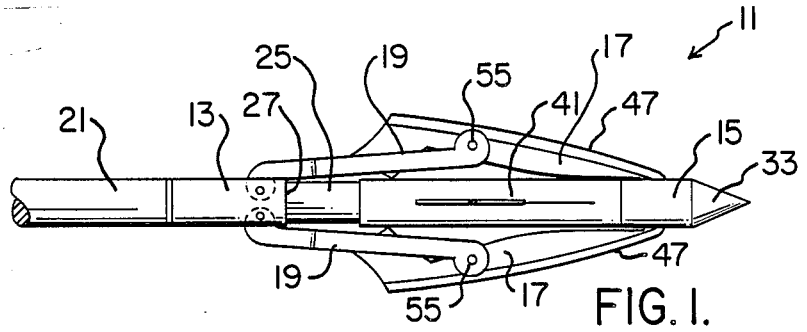
FIG. 1 is a side elevational view showing a preferred embodiment of an expandable arrowhead according to the present invention, with its blades in retracted configuration.
Figure 3:
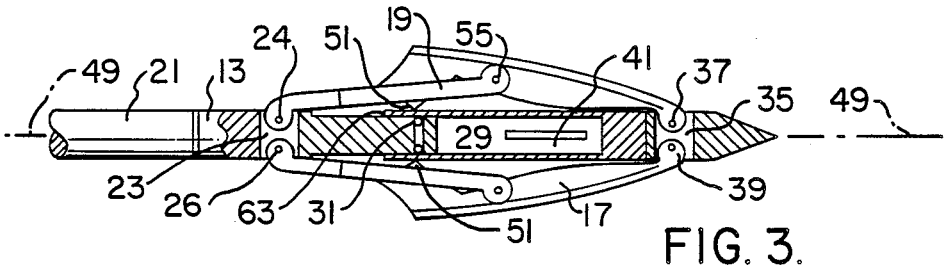
FIG. 3 is a partial sectional view taken along the line 3—3 of FIG. 2.

Referring now to the drawings, FIGS. 1 and 3 show that a preferred embodiment of an arrowhead 11 according to the invention is comprised principally of an elongate base member 13, elongate forward member 15, blades 17, and linking arms 19. The aforelisted components will be preferably fabricated of stainless steel, using fabrication techniques known in the metal-working industry. The invention may also be fabricated of other suitable metals such as aluminum and light weight steel alloys.

FIGS. 1 and 3 show that the elongate base member 13 is a generally cylindrical structure with a rear end that is threaded (not shown) for detachable connection to the front end of an arrow shaft 21 which will typically be made of aluminum in hollow tubular form. There is a transverse slot 23 extending through the midportion of base member 13, as best shown in FIG. 3, and a shaft 25, of reduced diameter, extends in a forward direction from a shoulder 27. FIG. 3 illustrates that near the front end of shaft 25 there is a peripheral groove 29 which receives a neoprene O-ring 31 that has a function which will be described hereinafter.

The elongate forward member 15 also has a generally cylindrical configuration with a pointed and preferably hardened front end 33. A transverse slot 35, adjacent the pointed end 33, will receive the front ends of blades 17 which are pivotally mounted about pins 37 and 39 as FIG. 3 illustrates. (Note that the transverse slot 23 receives the rear ends of linking arms 19 for their respective pivotal mounting for rotation about pins 24 and 26.) Note that the forward member 15 features a rearwardly elongated tubular portion or sleeve 41 which is designed to receive in a slidable manner the shaft 25 so as to guide the longitudinal movement of the forward member 15 relative to the base member 13.

An important component of the invention for deliberately limiting the movement of sleeve 41 with respect to shaft 25 is the O-ring 31. This elastomer component, supported in groove 29, is sized so that it presses animal's against the inner surface of sleeve 41 with a predetermined amount of force. This will establish an amount of static friction which must be overcome before relative motion of sleeve and shaft can occur. It will be later appreciated by those with ordinary skill in the art that the desirable amount of O-ring generated static friction is that which will hold arrowhead 11 in the configuration shown in FIG. 1 (the configuration to be held by arrowhead 11 when it is to be shot) and must be sufficiently large to withstand the inertial forces which tend to urge the forward member 15 towards the base member 13 during the instant of arrow acceleration and release from a bow. Yet the O-ring generated pressure is not so large as to prevent relative movement of these main arrowhead components towards each other when the arrowhead 11 impacts a target, in a manner to be described later herein. Note that the preferred embodiment includes a pair of diametrically located cutting blades 43 which have razor-sharp edges 45 and which are secured by suitable conventional means to the sleeve 41

Figure 2:
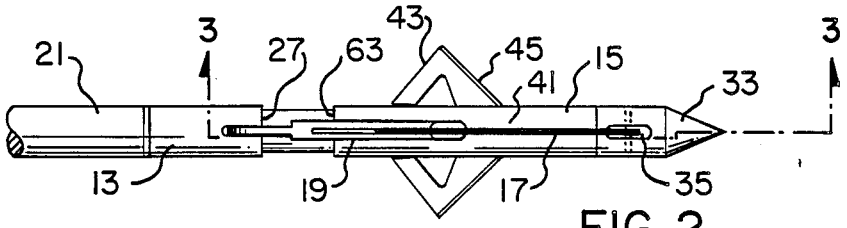
FIG. 2 is a top elevational view of the arrowhead of FIG, 1.
Figure 5:
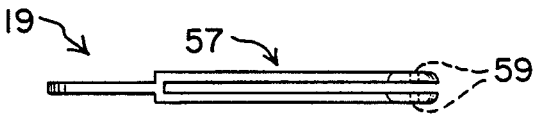
FIG. 5 is a partial, enlarged view of a linking arm.

In the preferred embodiment 11, a single pair of blades is used, however it is conceivable that the invention may be practiced in an embodiment having more than two blades. Note that blades 17 have sharpened leading edges 47. In FIGS..1, 2 and 3 the blades 17 are in their fully retracted configuration, and further inward rotation of blades 17 is prevented when rearward portions 51 abut the exterior of sleeve 41 as illustrated. Forward ends of the linking arms 19 pivotally connect with the blades 17 by means of pivoting pins 55. Note in the enlarged view of FIG. 5 that each linking arm 19 has a bifurcated portion 57 with apertures 59 in which the pivot pins 55 are secured. Note that the bifurcated portion 57 has arms that are sufficiently spaced apart to allow passage therethrough of the rearward portion 51 of blade 17. Thus FIGS. 1, 2 and 3 illustrate a retracted configuration of arrowhead 11 in which blades 17 are maximally swept back in a streamlined, aerodynamic shape which provides an effective cutting diameter that is minimal. Also note that the radial extent of retracted blades 17 is chosen to be somewhat less than the radial extent of the fletching or guide vanes (not shown) that are mounted to the rear of arrow shaft 21. This retracted configuration also coincides with the holding of sleeve 41 in a maximally forward position on the shaft 25. The aforedescribed O-ring will function to hold arrowhead 11 in this retracted configuration once it has been placed in this configuration by manually urging forward member 15 fully away from the base member 13.

Figure 4:
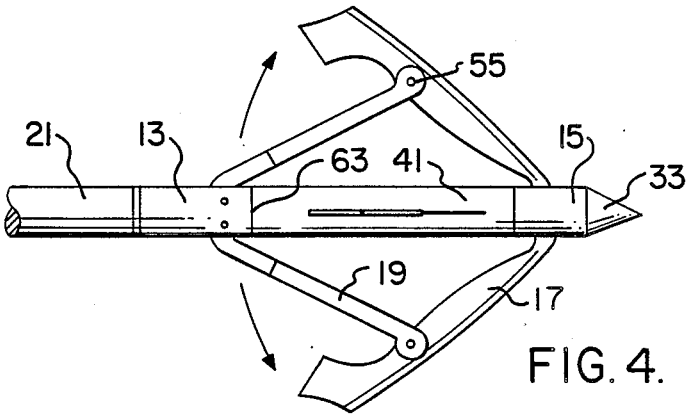
FIG. 4 is a view of the arrowhead of the invention with blades in extended configuration.

It will be seen that the aforedescribed linkage of pivotable components will allow blades 17 to be shifted to an extended configuration shown in FIG. 4 when forward member 15 is urged towards the base member 13 with sufficient force. In order to achieve this desired effect it will be appreciated that the blade/linking arm pivot pin 55 must be located so that the resultant of the compressive forces imparted to the linking arm and blade will urge it outwardly, away from the exterior of sleeve 41. Thus when arrowhead 11 is in its retracted configuration the pin 55 is offset outwardly of the imaginary line joining pivot pins 24 and 37. It will also be appreciated that the closer pivot pin 55 lies to this imaginary line the greater will be the inertially generated force necessary to produce the resulting outwardly acting force on pin 55. FIG. 4 shows the device 11 in its expanded configuration with blades 17 maximally extended, and with the forward member 15 shifted to a rearward position with the rear end 63 of sleeve 41 abutting the shoulder 27 to limit further rearward movement. The blades 17 with their cutting edges 47 are shown here to be significantly more divergent with respect to each other than in the retracted position aforedescribed, and thus provide a greatly increased cutting diameter and frontal cross sectional area.

When the aforedescribed arrowhead 11 is to be used, it is attached to arrow shaft 21 and then set into its retracted configuration as described above, with O-ring 31 functioning as described to hold this configuration during loading, aiming and release of the arrow from a bow. Arrowhead 11 will hold its streamlined, retracted configuration until it makes impact with a target mass. As the forward member 15 penetrates the target mass its motion is severely retarded relative to the base member 13 and the arrow shaft 21, and the forward member 15 will be urged towards the base member 13 with sufficient force to overcome the static resistance presented by O-ring 31. This will force blades 17 outwardly towards their extended configuration that provides the enlarged cutting surfaces and frontal area through which the considerable kinetic energy of the arrow is transferred in a lethal manner to the targeted animal.

While there has been described herein a particular embodiment of the invention, it will be obvious to those skilled in the art that various changes and modifications may be made therein without departing from the invention. Therefore it is aimed to cover all such changes as fall within the true spirit and scope of this invention.

What is claimed is:

1. An expandable head for a hunting arrow comprising:

(a) a first elongate member having a rear end adapted to he attached to the front end of an arrow shaft, and having a longitudinally extending forward portion;

(b) second elongate member having a pointed front end and a rearwardly extending portion that is adapted to slidably connect to said forward portion of said first member for axial movement relative to said first member, from a forward position to a rearward position;

(c) a first and at least a second blade each of said blades having its front end pivotally connected to said second elongate member;

(d) a first and at least a second linking arms, each said arm having a rear end pivotally connected to said first elongate member, and said first and second linking arms having forward ends that pivotally attach respectively to said first and second blades, at a connection point on each said blade that is spaced from the front end of said blade;

(e) means, operative between the forwardly extending portion of said first elongate member and the rearwardly extending portion of said second member, for exerting a predetermined static frictional force for holding said first and said second members against relative sliding movement; and (f) wherein said first and second blades have a retracted configuration in which said blades lie slightly divergent with respect to each other and said second member lying in its forward position relative to said first member when said blades are retracted, and wherein when said second member is urged toward its rearward position by forces of impact of said second member with a target said blades are caused to rotate to an extended, more divergent configuration.

2. Apparatus defined in claim 1 wherein said first and said second member are generally cylindrical.

3. Apparatus as defined in claim 2 wherein the rearwardly extending portion of said second member is tubular and receives the longitudinally extending portion of said first member.

4. Apparatus as defined in claim 1 wherein the forward end of each said linking arms connects with a midportion of respective ones of said blades.

5. Apparatus as defined in claim 1 including means limiting rearward sliding movement of said second member beyond said rearward position.

6. Apparatus as defined in claim 5 wherein said first member provides an abutting surface which is adapted to engage said second member to stop further rearward movement of said second member when in its rearward position.

7. Apparatus as defined in claim 1 wherein the rearwardly extending portion of said second member is tubular and receives the longitudinally extending portion of said first member, and wherein there is a shoulder portion adjacent said longitudinally extending forward portion for engaging the rearward end of the rearwardly extending portion of said second member when said second member is in its rearward position.

8. Apparatus as defined in claim 1 wherein said first and said second members are generally cylindrical and where the pivotal connection at the rear end of each of said linking arms, and the front end connection of each said blades are located within the confines of said first and said second members respectively, and the pivotal connection made by the forward end of each of said linking arms when said blades are in their retracted configuration is spaced a predetermined distance from the exterior of said second member.

9. Apparatus as defined in claim 1 wherein the pivotal connection made by the forward end of each of said linking arms, when said blades are in their retracted configuration, is spaced a predetermined distance from a straight line adjoining the rear end connection of said linking arm and the front end connection of said blade.

10. Apparatus as defined in claim 1 wherein the outer edge of each said blade is sharpened.

11. Apparatus as defined in claim 10 wherein the effective radial extension of said sharpened edges when said arrowhead is viewed frontally and in their retracted configuration, is substantially less than the effective radial extent of said sharpened edges when said blades are in their extended configuration.

12. Apparatus as defined in claim 1 wherein the frontal configuration presented by said arrowhead when said blades are in their extended configuration is substantially larger than the frontal configuration presented by said arrowhead when said blades are retracted.

13. Apparatus as defined in claim 1 wherein the rear end of said arrow shaft is equipped with fletchings and wherein the radial extension of said blades in their retracted configuration is less than the radial extent of said fletchings.

14. Apparatus as defined in claim 1 wherein the transverse cross sectional configuration of said arrowhead when said blades are in their extended configuration is substantially greater than the cross sectional configuration presented by said arrowhead when said blades are retracted.

15. Apparatus as defined in claim 1 wherein an inward surface of each said blade is adapted to abut said second elongate member when said blades are in their retracted configuration so as to limit the inward rotation of said blades.

16. Apparatus as defined in claim 1 including a protecting portion of each of said linking arms, which portion is adapted to abut said second elongate member to limit inward rotation of said blades when in their retracted configuration.

17. Device as defined in claim 1 including resilient means mutually engaged by said first member and said second member so as to generate a predetermined amount of static friction which must be overcome before said first and said second members can have mutual axial movement.

18. Device as defined in claim 17 wherein said resilient means is a rubber-like polymeric material.

19. Device as defined in claim 18 wherein said resilient means comprises an O-ring that embraces the forwardly extending portion of said first elongate member.

* * * * *